US005351625A

United States Patent [19]

Culligan et al.

[11] Patent Number: 5,351,625

[45] Date of Patent: Oct. 4, 1994

[54] WELD SUPPORT FOR RAILWAY TANK CAR UNDERBODY CONSTRUCTION

[75] Inventors: Laurence E. Culligan, Portage Des Sioux; Paul J. Dumser, St. Charles, both of Mo.

[73] Assignee: ACF Industries, Earth City, Mo.

[21] Appl. No.: 89,305

[22] Filed: Jul. 12, 1993

[51] Int. Cl.[5] ..... B61D 5/00

[52] U.S. Cl. ..... 105/362; 219/137 R; 228/215; 228/189; 228/182

[58] Field of Search ..... 105/362, 358, 360, 361; 219/137 R; 228/215, 189, 182

[56] References Cited

U.S. PATENT DOCUMENTS

| | | | |
|---|---|---|---|
| 1,632,523 | 6/1927 | Turner | 105/362 |
| 3,467,027 | 9/1969 | Brown | 105/362 |
| 3,645,213 | 2/1972 | Taylor | 105/362 |
| 4,284,012 | 8/1981 | Hrinsin | 105/362 |
| 4,805,540 | 2/1989 | Mundloch et al. | 105/358 |
| 5,159,882 | 11/1992 | Krug et al. | 105/362 |

FOREIGN PATENT DOCUMENTS

| | | | |
|---|---|---|---|
| 1654072 | 6/1991 | U.S.S.R. | 105/362 |

*Primary Examiner*—Mark T. Le

*Attorney, Agent, or Firm*—Polster, Lieder, Woodruff & Lucchesi

[57] ABSTRACT

A weld support (50) for use with a center sill assembly (16) for supporting a cradle pad (12) used to support the end of a railway tank car body (B). The center sill assembly includes first and second spaced apart side plates (18, 20) spaced to either side of the car body, and a top plate (28). The weld support comprises first and second support members (52, 54) installed on opposite sides of the assembly. A pocket (56) is formed in the center sill assembly on each side thereof. A respective weld support member is attached to the top plate adjacent the respective pockets, for the weld support members to extend above the upper surface of the top plate. The weld support members each provide a substantial contact surface with the cradle pad. Each weld support member also helps pool welding material in the respective pockets to effect a strong weld between the cradle pad and center sill assembly.

22 Claims, 4 Drawing Sheets

WELD SUPPORT FOR RAILWAY TANK CAR UNDERBODY CONSTRUCTION

BACKGROUND OF THE INVENTION

This invention relates to the fabrication of tank cars for railway use and, more particularly, to a weld support for use in fabricating the underbodyframe of a tank car.

During fabrication of the underframe assembly for a railway tank car, a critical step involves the attachment of the sill assembly portion of the underframe to the tank. A railway tank car underbody and a method of its construction are shown, for example, in U.S. Pat. No. 5,159,882, which is assigned to the same assignee as the present application. As shown in the center sill assembly 102 of FIG. 11 in the '882 patent, respective metal bars 128, 130 are welded to the respective upper, inner faces of side plates 118, 120. A top plate 132 is welded to the bars and extends longitudinally of the side plates. The cradle pad 108 for tank car body 106 is the welded to the center sill assembly.

The initial outboard weld; i.e., the weld between the cradle pad and the center sill assembly, is critical. In this regard, the construction shown in the '882 patent includes a weld attachment for assembly of the cradle pad 108 to the center sill assembly. This arrangement includes a bevel weld and a fillet weld. While this assembly method effectively attaches the cradle pad and center sill assembly together, the weld effectiveness is only as strong as the sill web. It will be appreciated that the length of the weld, and the amount of weld material which can be used to complete the weld is limited by the space limitations imposed by the design and fabrication of the center sill assembly. The problem with this current arrangement is that as haulers are looking for tank cars with higher load capabilities, the strength limitation imposed by this construction could inhibit the manufacture of tank cars with the desired increased capabilities.

Different approaches have been considered to provide a stronger weld between the cradle pad and center sill. One approach, for example, would be for the top cover plate to have a contoured upper surface. The contour would correspond to that of the botton portion of the cover pad attached to the center sill by welding along the top plate. While feasible, this approach is also expensive since the top plate would not be a standard piece of steel. In addition, the top plate would probably be heavier, thus adding weight to the railcar.

SUMMARY OF THE INVENTION

Among the several objects of the present invention may be noted the provision of a weld support for the underframe of a railway tank car; the provision of such a weld support which is usable with many types of tank cars including, for example, insulated and non-insulated tank cars, straight barrel tank cars, and tip-tank tank cars; the provision of such a weld support which facilitates a larger, stronger, and more effective weld between the top cover and side plates of the center sill assembly as well as between the sill assembly and tank cradle pad than was previously possible; the provision of a pair of weld supports, one on either side of the top plate; the provision of each weld support to create a pocket in which weld material pools at the juncture between the center sill and cradle pad so more material is available at the weld site to produce a stronger weld; the provision of such a weld support to provide a longer contact surface and more contact surface area between the cradle pad and center sill assembly; the provision of such a weld support which is readily installed during fabrication of the center sill assembly; the provision of such a weld support which is used on the center sill assembly at each end of the railcar; the provision of such a weld support usable in fabricating support assemblies for other types of tanks; and, the provision of such a weld support which is low cost, readily manufactured, and easily stored prior to use.

In accordance with the invention, generally stated, a weld support is for use with a center sill assembly. The assembly supports a cradle pad which, in turn, supports one end of a railway tank car body. The center sill assembly includes first and second spaced apart side plates spaced to either side of the car body, and a top plate. The weld support comprises first and second support members installed on opposite sides of the assembly. A pocket is formed in the center sill assembly on each side thereof. A respective weld support member is attached to the top plate adjacent the respective pockets. The weld support members extend above the upper surface of the top plate. The weld support members each provide a substantial contact surface with the cradle pad. Further, each weld support member helps pool welding material in the respective pockets to effect a strong weld between the cradle pad and center sill assembly. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF PREFERRED EMBODIMENTS

Figure 1:
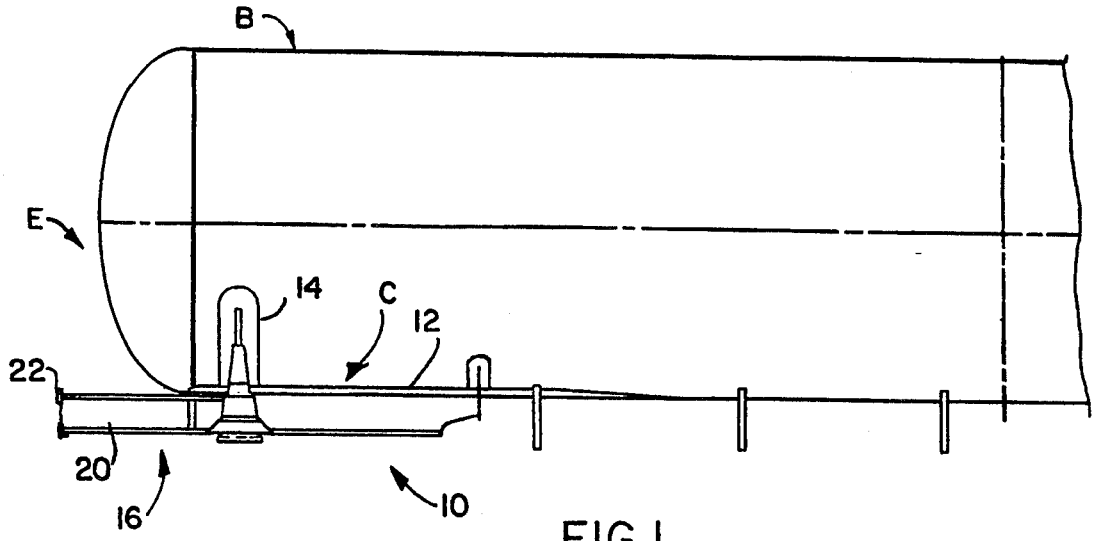
FIG. 1 is a representation of a straight barrel railway tank car having an underframe structure made in accordance with the present invention.
Figure 2:
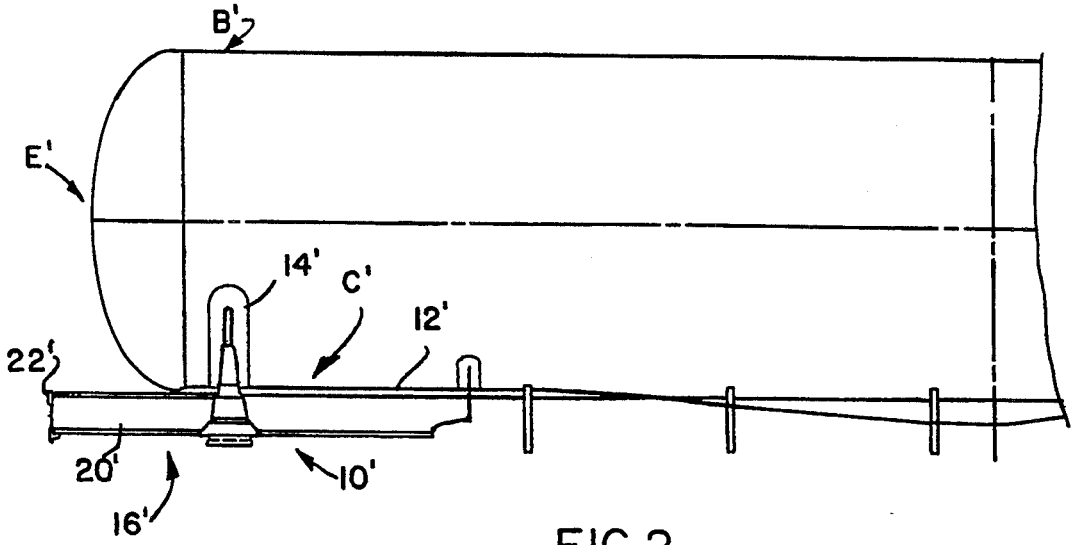
FIG. 2 is a representation similar to FIG. 1 for a tip-tank railway car.
Figure 3:
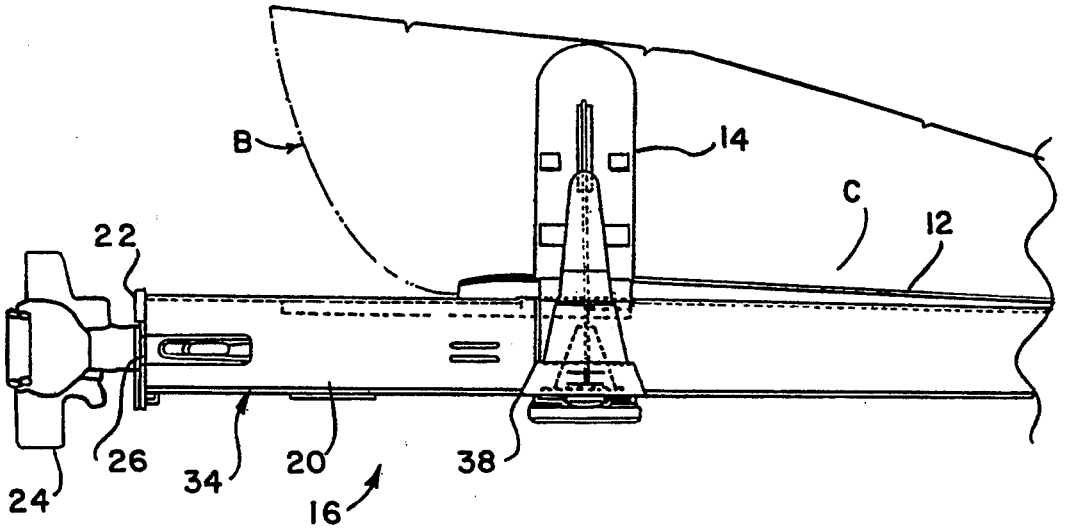
FIG. 3 is a side elevational view of a center sill assembly for a railway tank car.

Referring to the drawings, an underbody structure of the present invention is indicated generally 10. Underbody 10 supports an end E of an elongate railway car body B. As shown in FIG. 1, body B is what is commonly referred to as a "straight barrel" body. Alternately, as shown in FIG. 2, a body B' has a tapered or sloped bottom portion and is commonly referred to as a "tip tank" body. In addition to the overall body shape, the tank may also be either insulated, or non-insulated. Regardless, the body is cradled in a cradle pad assembly, C or C' respectively. The formation of the tank car body and its associated cradle pad assembly form no part of this invention. However, for purposes of understanding the invention, the cradle pad assembly includes a curved, draft sill reinforcing plate 12, also referred to as the tank cradle pad. This plate extends beneath the tank car parallel to the longitudinal centerline thereof. The curvature of the plate corresponds to that of the tank car body. A bolster reinforcing plate 14, or tank cradle, curves around the underside of the tank car body and upwardly along each side of the body. Again, the curvature of the tank cradle corresponds to that of the tank car body. There is a cradle pad assembly at each end of the tank car.

Underbody 10 first includes a center sill assembly 16. As with the cradle pad, there is a center sill assembly at each end of a tank car. Because the center sill assemblies are essentially identical in design and construction, only one is described in detail. The center sill assembly includes first and second spaced apart side plates 18, 20. The side plates extend longitudinally along each side of the tank body, and are equidistantly spaced to either side of the longitudinal centerline of the tank body. The height of the side plates increase from a shorter to a larger height at a point just rearward of the point where cradle pad assembly C is attached to center sill assembly 16. This point is indicated X in the drawing figures. The side plates are joined together, at the forward end of the center sill assembly by a striker plate 22. A coupler 24 for coupling railcars together is mounted to the sill assembly at this end of it. One end of the coupling fits through an opening 26 in the striker plate.

Figure 4:
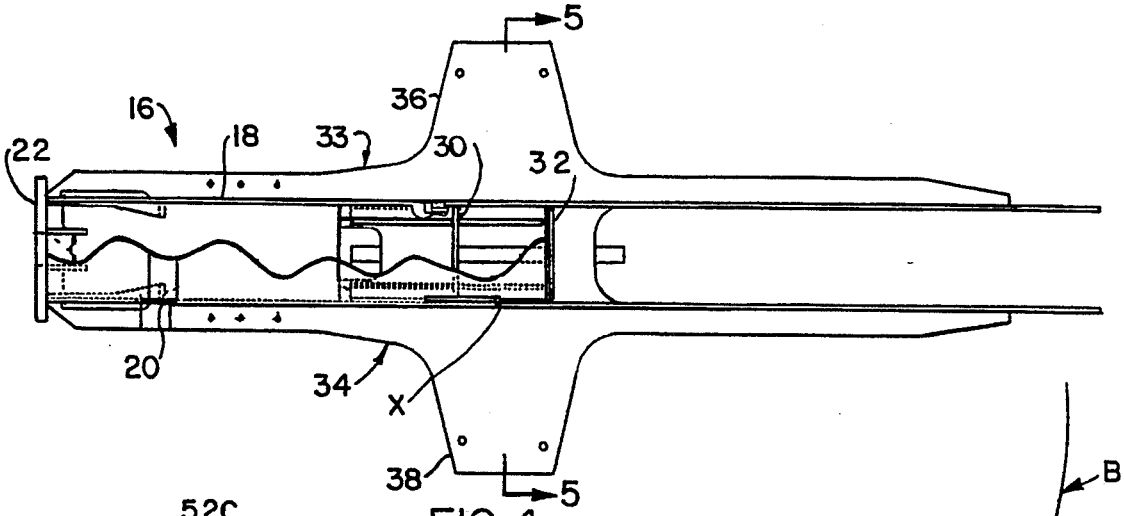
FIG. 4 is a top plan view, partly in section, of the center sill assembly of FIG. 3.

The center sill assembly also includes a top plate 28. Plate 28 has a thickness of approximately 0.875 in. (2.22 cm.). The width of the plate corresponds to the distance between side plates 18, 20. As shown in FIG. 4, a pair of plates 30, 32 extend transversely of the side plates. These plates are parallel to each other with the forward of the two plates (plate 30) being located slightly forwardly of the step increase in height of the side plates. The rearward of the plates (plate 32) is located approximately 12 in.–13 in. to the rear of the first plate. Top plate 28 extends from striker plate 22 rearwardly to transversely extending plate 30.

Figure 5:
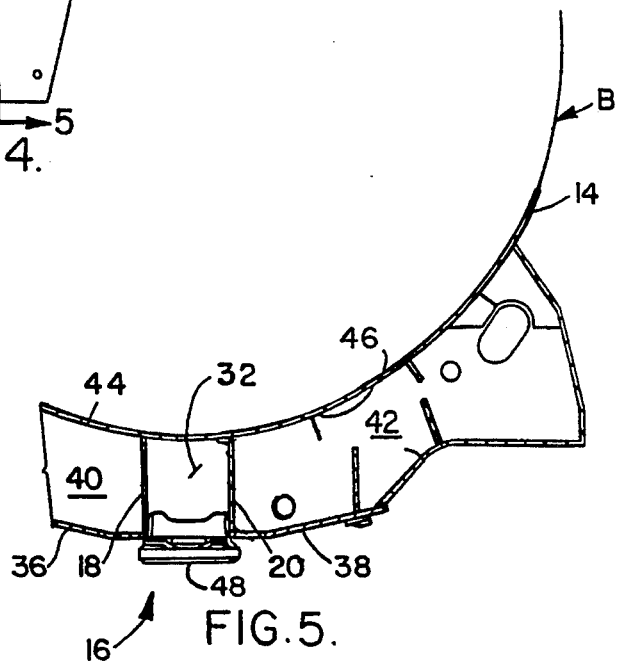
FIG. 5 is a sectional view taken along line 5—5 in Fig. 4.
Figure 8:
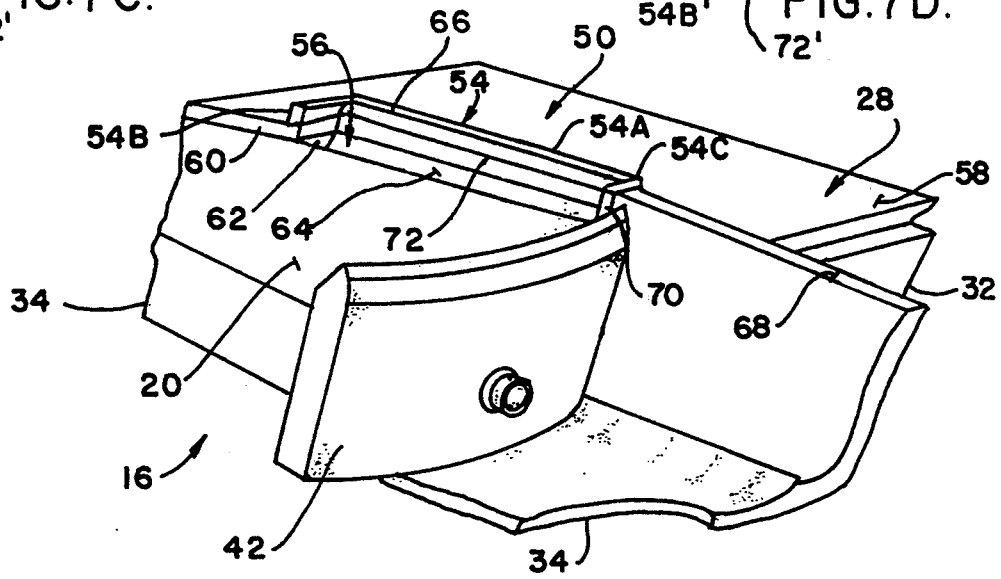
FIG. 8 is a perspective view of the portion of the center sill assembly where a weld support is installed.

A flange 33, 34 is attached to, and extends longitudinally of, each side plate. The flanges are welded at the lower end of each side plate. The flanges extend laterally outward from the side plates. Each flange includes a bottom bolster section 36, 38 respectively. Referring to FIGS. 5 and 8, a bolster web 40, 42 is welded to the respective bottom bolster sections. The upper end of each web is curved to match the contour of the tank cradle 14. Each bolster web may be formed from a plurality of plates which are welded together. Respective top bolster plates 44, 46 are attached to the upper, contoured surface of the webs. The plates 44, 46 support the respective curved sides of the tank cradle. As also shown in FIG. 5, a main bearing assembly 48 is secured to the center sill assembly between the lower end of the respective side plates. The main bearing assembly, in turn, fits upon a truck center plate of a truck (not shown).

Figure 14:
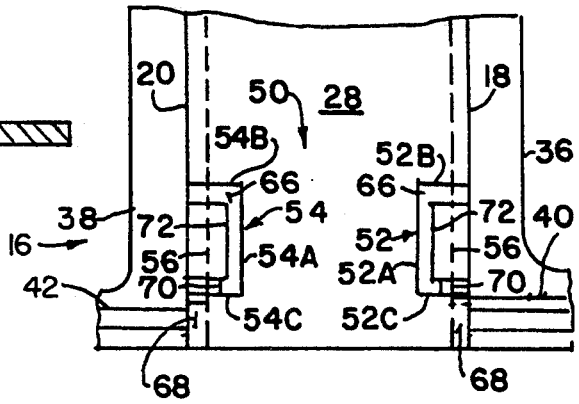

Next, a weld support 50 comprises a weld support member 52 and a weld support member 54, one or both of which are installed on center sill assembly 16. See FIG. 14. Each weld support member is a forged, generally U-shaped unit (in plan) having a center section 52A, 54A, and respective end segments 52B, 54B, and 52C, 54C. End segments 52B, 54B, are wider than end segments 52C, 54C. This is because end segments 52C, 54C are adjacent the location X of the side plates where there is the step increase in height. Each weld support member is attached to the center sill assembly by welding the support to top plate 28 at respective sides of the top plate as shown in FIG. 14. For this purpose, the bottom of the weld support member is flat. The weld support members 52, 54, as described above and shown in FIG. 6, are for use on a center sill assembly used for a straight barrel tank B. A corresponding weld support member 52' 54' for use with a tip-tank tank B', is shown in FIG. 7. Because the two constructions have only minor differences between them, only the configuration and use of the weld supports 52, 54, are described in detail.

Figure 9:
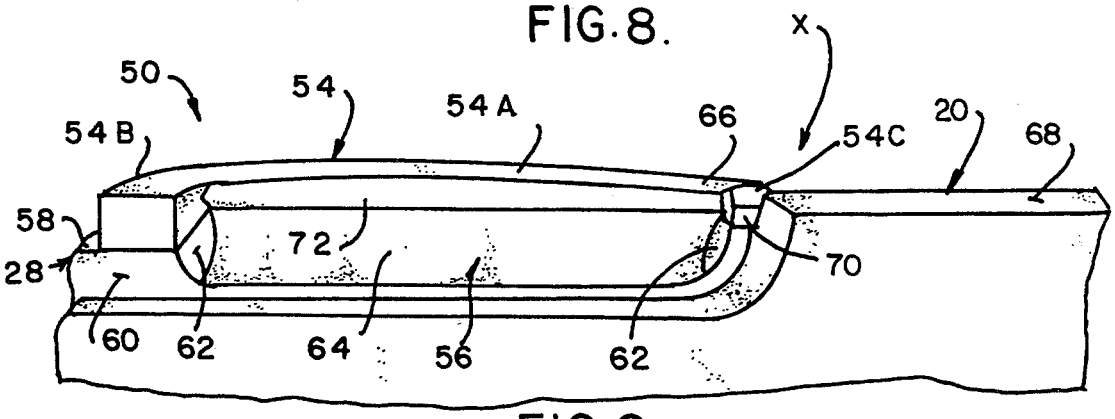
FIG. 9 is another perspective view showing the portion of the center sill assembly with the weld support installed.
Figure 10:
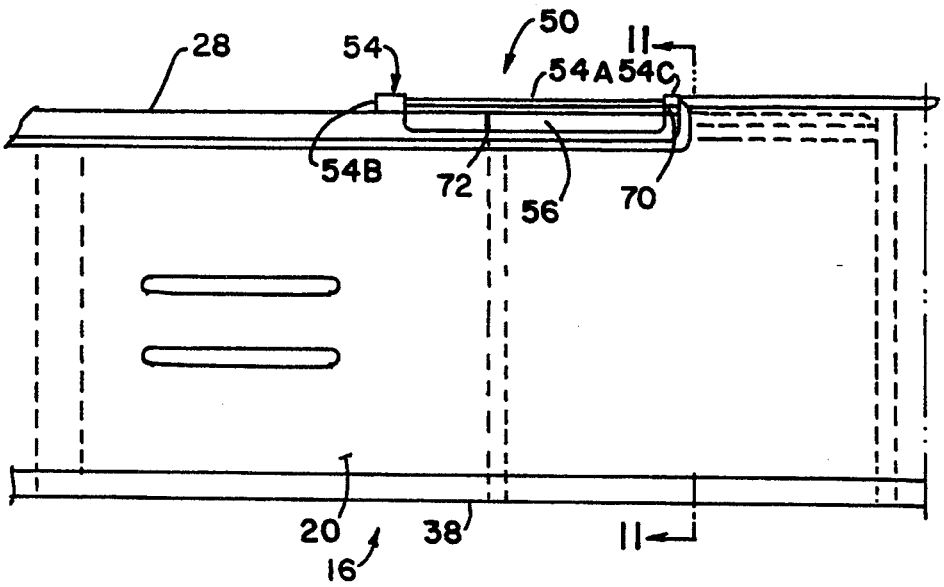
FIG. 10 is a partial side elevational view of the center sill assembly with a weld support installed.
Figure 12:
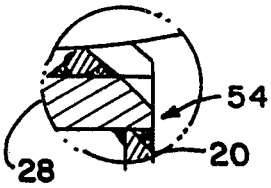
FIG. 12 is an enlarged view of a portion of the sectional view of FIG. 11.
Figure 13:
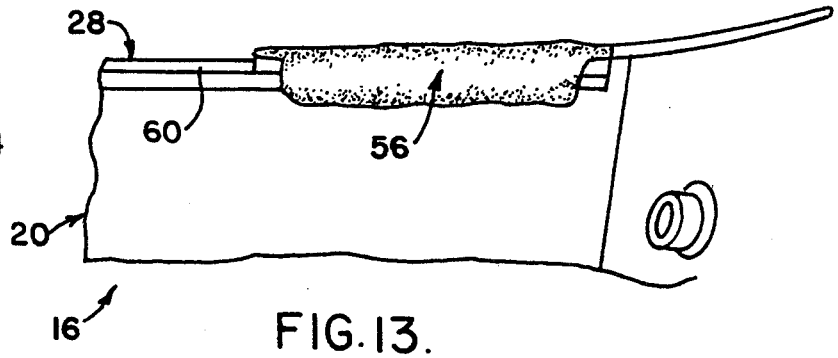
FIG. 13 is a perspective view of the center sill assembly with the tank car cradle pad attached at the weld support location; and, FIG. 14 is a partial top plan view of the center sill assembly showing installation of weld support members.
Figure 11:
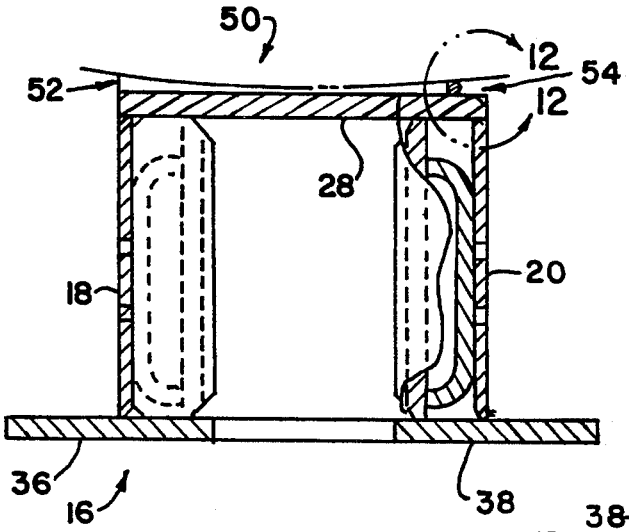
FIG. 11 is a sectional view taken along line 11—11 in FIG. 10.

As particularly shown in FIGS. 8 and 9, a pocket 56 is formed in the center sill assembly. Pocket 56 is formed by cutting away a portion of top plate 28 and the respective side plate 18 or 20, at the junction formed by the respective side plate and top plate during fabrication of the center sill assembly. Each pocket is formed after the top plate has been joined with the side plates. Referring to FIGS. 8 and 9, top plate 28 has a generally diagonal cut made from its top face 58 to its side face 60. These cuts extend approximately 1 in. (2.54 cm.) into the top surface of plate 28, from the side of the plate. The spacing between the cuts corresponds to the width of weld support member between its end pieces. This width is, for example, 9 in. (22.8 cm.). While the cuts are generally made only in the top plate, they may extend into the respective side plate, if so desired. After the diagonal cuts are made, a longitudinal cut is made along top surface 58 of plate 28. The length of this cut corresponds to the width of the weld support member. Once the cuts are made, the material they encompass is cutaway. In doing so, a curved or scalloped surface is formed in the top plate. The removed material leaves a pocket 56 having vertical end walls 62, and the curved sidewall 64.

When each weld support member is attached to top plate 28 adjacent the respective pockets 56, the members then extend above upper surface 58 of the top plate. As shown in FIGS. 8, 9, 13, and 14, the top surface 66 of the members, at end piece 52C, 54C of the respective members, is generally flush with upper edge 68 of side plate 18 or 20. This is because this end of the weld support member is adjacent the location X referred to previously where there is a step increase in the height of the side plates. Accordingly, the bottom surface of cradle pad 12 now rests against upper surface 66 of each weld support member. Heretofore, the length of support corresponded to the length of the stepped-up height portion of the side plate upon which the cradle pad rested. Now, however, the support surface, on both sides of the center sill assembly, is increased by the length of the weld support members. This increase in length is, for example, 10.5 in. (26.7 cm.), which is a substantial increase in the contact surface between the center sill assembly and cradle pad. In this regard, with respect to FIGS. 6B and 7B, it will be noted that the height of weld support members 52, 54, is generally uniform along the length of the support. For support members 52', 54', the height of the weld support member decreases from one end (52B', 54B') to the other (52C'54C') This is because the lower surface of the tip-tank tapers or slopes downwardly toward the center of the railcar.

In addition to the increase in length, each end leg of the weld support members increase in height from the inner to the outer end of the member, as installed. This increase in height generally corresponds to the change in height of the cradle pad above the center sill assembly, as caused by the curved surface of cradle pad 14. Thus, the surface area on which the cradle pad is supported also is slightly increased by the use of the weld support members. This latter feature is the same for weld supports used with either the straight barrel or tip-tank design. For end piece 52C, 54C, the increase in height from the inner to outer end of the weld support only extends to the point where the height of the end piece corresponds with the stepped-up height of the associated side plate. From there, to the outer end 70 of the end piece, the height of the end piece tapers off. Otherwise, if the height of the end piece further increased, or levelled off, there could be a misalignment of the cradle pad with the center sill assembly.

Figure 6D:
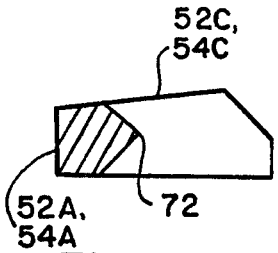
FIG. 6D is a sectional view taken along line 6D—6D in FIG. 6B.
Figure 6A:
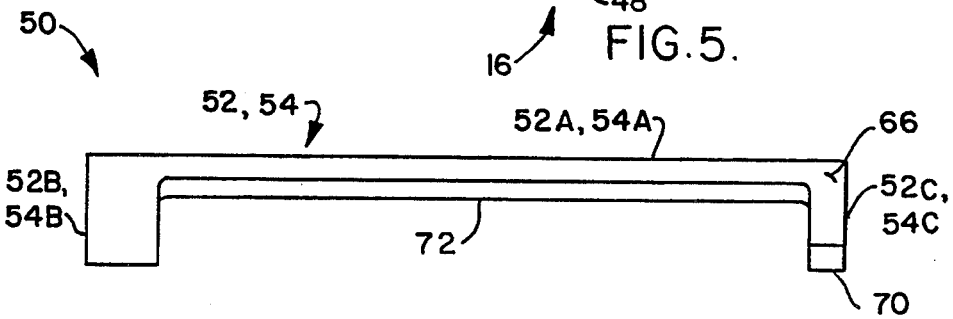
FIGS. 6A–6C are respective top plan, and front and end elevational views of a weld support for use in fabricating the center sill assembly for a straight barrel tank car.
Figure 6B:
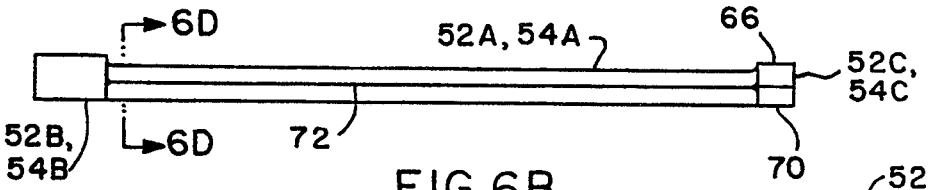
Figure 6C:
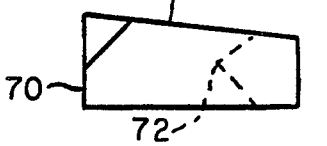
Figure 7A:
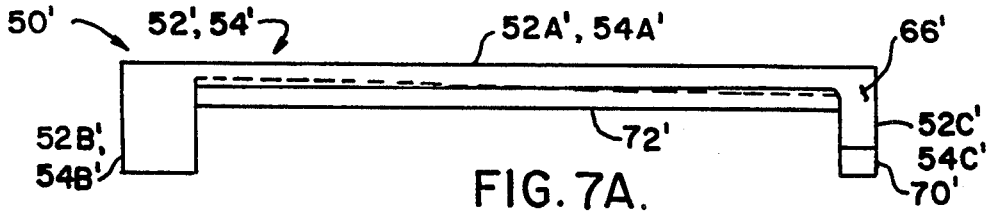
FIGS. 7A–7D are views corresponding to FIGS. 6A–6D for a weld support for use in fabricating a center sill assembly for a tip-tank car.
Figure 7B:
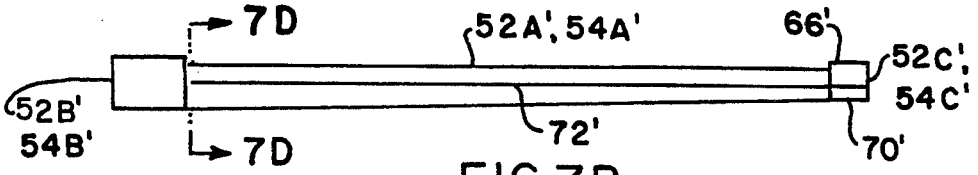
Figure 7C:
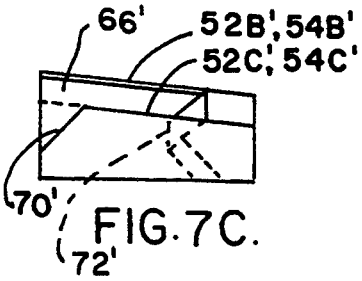
Figure 7D:
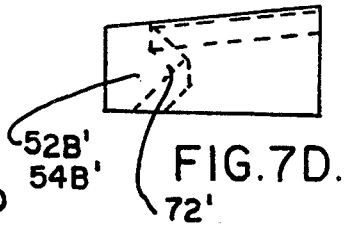

As noted, the respective weld supports are installed by welding them to upper surface 58 of top plate 28. Thereafter, when the cradle pad is to be attached to the center sill assembly, welding material used at the junction between the weld support member and cradle pad, pools or collects in pocket 56. It is an additional feature of the supports to help effect this pooling. To this end, the center section of each weld support is shown in FIGS. 6C and 6D to be triangular in cross-section. The apex 72 of this triangle extends outwardly over pocket 56. This triangular face of the weld support thus forms a fourth and enclosing side of the pocket. As such, it allows welding material to pool in the pocket. By accumulating welding material, more material is available for forming a bead along the junction between the cradle pad and weld support. This makes for a stronger weld.

What has been described is a weld support for use in fabricating the underframe of a railway car. While the above description of the weld support and its use are for a railway tank car, those skilled in the art will appreciate its adaptability for use in other rail car or similar constructions. The weld support is usable with many types of tank cars such as straight barrel and tip-tank tank cars, as well as insulated and non-insulated tank cars. Use of the weld support effects a longer and stronger weld between the top cover and side plates of the car's center sill assembly, as well as between the center sill assembly and cradle pad. The weld support is installed on both sides of the sill assembly and each support helps form a pocket for pooling welding material so more material is available at the weld site. Each weld support also provides a longer contact surface, and more contact surface area, between the tank's cradle pad and center sill assembly so a longer and more stronger weld is provided. The weld supports are readily installed during fabrication of the center sill assembly. Finally, the weld supports are low cost, forged pieces which are readily fabricated in different sizes and easily stored, on site, prior to use.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A weld support for use with a center sill assembly for supporting a cradle pad used to support the end of a railway tank car body, the center sill assembly including first and second spaced apart side plates spaced to either side of a longitudinal centerline of the car body and a top plate extending a portion of the length of the center sill assembly, and the weld support comprising first and second support members respectively installed on the center sill assembly on both sides of the assembly, a pocket being formed in the center sill assembly on each side thereof during fabrication of the center sill assembly, and each weld support member being attached to the top plate adjacent the respective pockets for the weld support members to extend above the upper surface of the top plate, the weld support members each providing a substantial contact surface with the cradle pad, and each weld support member helping pool welding material in the respective pockets to help effect a strong weld between the cradle pad and the center sill assembly.

2. The weld support of claim 1 wherein each weld support member has an elongate center section extending lengthwise of the center sill assembly, and integrally formed end segments at each end of the center section, the end segments extending outwardly toward the sides of the center sill assembly when the weld support member is installed in place.

3. The weld support of claim 2 wherein each weld support member is generally U-shaped when viewed in plan.

4. The weld support of claim 2 wherein the bottom surface of each weld support member is generally flat for the weld support member to rest on an upper surface of the top plate.

5. The weld support of claim 2 wherein the height of the end segments of each weld support member increases from the center section outwardly to the outer end of each end segment, the change in height approximating a curvature of the cradle pad for the underside of the cradle pad to rest upon an upper surface of each weld support member substantially along the width of the weld support member.

6. The weld support of claim 5 wherein the center section has a triangular shaped inner wall extending between the end segments, the inner wall and end segments forming a dam to pool welding material collecting in the pocket.

7. The weld support of claim 6 wherein one end segment is wider than the other.

8. The weld support of claim 1 wherein the car body is a straight barrel tank body.

9. The weld support of claim 1 wherein the car body is a tip-tank body.

10. A weld support for use with a center sill assembly for supporting a cradle pad used to support the end of a railway tank car body, the center sill assembly including first and second spaced apart side plates spaced to either side of the car body and a top plate extending a portion of the length of the center sill assembly, and the weld support comprising a weld support member installed on the center sill assembly assembly, a pocket being formed in the center sill assembly and the weld support member being attached to the center sill assembly adjacent the pocket for the weld support member to extend beyond the assembly to provide a substantial contact surface with the cradle pad, the weld support member helping pool welding material in the pocket to thereby help effect a strong weld between the cradle pad and the center sill assembly.

11. The weld support of claim 10 wherein the pocket is formed in the top plate adjacent where the top plate meets a side plate, and the weld support is attached to the top plate.

12. The weld support of claim 10 wherein the weld support has an elongate center section extending lengthwise of the center sill assembly, and integrally formed end segments at each end of the center section, the end segments extending outwardly toward the sides of the center sill assembly when the weld support is installed in place.

13. The weld support of claim 12 wherein the weld support is generally U-shaped when viewed in plan.

14. The weld support of claim 12 wherein the height of the end segments increases from the center section outwardly to the outer end of each end segment, the change in height approximating a curvature of the cradle pad for the underside of the cradle pad to rest upon an upper surface the weld support substantially along the width of the weld support.

15. The weld support of claim 14 wherein the center section has a triangular shaped inner wall extending between the end segments, the inner wall and end segments forming a dam to pool welding material collecting in the pocket.

16. The weld support of claim 15 wherein one end segment is wider than the other.

17. A weld support for use in fabricating a support assembly for a tank, the support assembly including first and second spaced apart side plates spaced to either side of a longitudinal centerline of the tank and a top plate extending a portion of the length of the support assembly, the weld support comprising first and second support members respectively installed on the support assembly on both sides thereof, a pocket being formed in the support assembly on each side thereof during fabrication of the support assembly, each weld support member being attached to one of the plates adjacent the respective pockets for the weld support members to extend beyond an outer of the plate, the weld support members each providing a substantial contact surface with the tank, and each weld support member helping pool welding material in the respective pockets to help effect a strong weld between the tank and the support assembly.

18. The weld support of claim 17 wherein said tank is supported by a cradle pad and the weld support members are welded to the cradle pad.

19. The weld support of claim 18 wherein the pockets are formed in the top plate and the weld support members are welded to the top plate adjacent the respective pockets.

20. The weld support of claim 19 wherein each weld support member is generally U-shaped, in plan, and has has an elongate center section extending, and integrally formed end segments at each end of the center section, the end segments extending outwardly toward the sides of the support assembly when the weld support member is installed in place.

21. The weld support of claim 20 wherein the height of the end segments increases from the center section outwardly to the outer end of each end segment, the change in height approximating a curvature of the cradle pad for the underside of the cradle pad to rest upon an upper surface the weld support substantially along the width of the weld support.

22. The weld support of claim 21 wherein the center section has a triangular shaped inner wall extending between the end segments, the inner wall and end segments forming a dam to pool welding material collecting in the pocket.

* * * * *